United States Patent [19]

Severin

[11] 4,235,189

[45] Nov. 25, 1980

[54] APPARATUS FOR APPLYING PULVERULENT COLORING MATTER TO WEBS OF CIGARETTE PAPER OR THE LIKE

[75] Inventor: Hans H. Severin, Hamburg, Fed. Rep. of Germany

[73] Assignee: Hauni-Werke Körber & Co. KG, Hamburg, Fed. Rep. of Germany

[21] Appl. No.: 961,197

[22] Filed: Nov. 16, 1978

[30] Foreign Application Priority Data

Nov. 26, 1977 [DE] Fed. Rep. of Germany ..... 2752865

[51] Int. Cl.[3] ..... B05C 1/08; B05C 19/00

[52] U.S. Cl. ..... 118/119; 118/248; 118/259

[58] Field of Search ..... 118/248, 119, 118, 259, 118/653, 656, 657; 198/496

[56] References Cited

U.S. PATENT DOCUMENTS

| | | | |
|---|---|---|---|
| 289,718 | 12/1983 | Schaefer | 198/496 X |
| 2,169,078 | 8/1939 | Waite | 118/119 X |
| 3,122,453 | 2/1964 | Montgomery | 118/653 X |
| 3,659,556 | 5/1972 | Mutschler | 118/656 X |
| 3,820,505 | 6/1974 | Goldbach et al. | 118/118 |

FOREIGN PATENT DOCUMENTS

| | | | |
|---|---|---|---|
| 289581 | 1/1916 | Fed. Rep. of Germany | 118/248 |

*Primary Examiner*—John P. McIntosh
*Attorney, Agent, or Firm*—Peter K. Kontler

[57] ABSTRACT

Apparatus for applying bronze powder to adhesive-coated portions of one side of a running web of cigarette paper has a magazine for a supply of bronze powder and a feed screw which draws powder from the magazine and delivers some of the withdrawn powder into a chamber for a transfer wheel whose peripheral surface applies powder to the one side of the web. The powder which fails to adhere to the web is returned into the helical groove of the feed screw upstream of the chamber. A cylindrical sleeve which surrounds the feed screw has an outlet located downstream of the chamber and serving to return into the magazine such powder which is transported beyond the chamber. The sleeve has a longitudinally extending slot for a brush whose bristles extend into the helical groove of the feed screw to prevent agglomeration of powder in the groove.

6 Claims, 2 Drawing Figures

APPARATUS FOR APPLYING PULVERULENT COLORING MATTER TO WEBS OF CIGARETTE PAPER OR THE LIKE

BACKGROUND OF THE INVENTION

The present invention relates to apparatus for applying pulverulent coloring matter, especially bronze powder, to webs of cigarette paper or the like. More particularly, the invention relates to improvements in apparatus for applying pulverulent coloring matter to selected portions of one side of a running web which is to be converted into the wrapper of a rod-like filler consisting of tobacco and/or filter material. Still more particularly, the invention relates to improvements in apparatus wherein a mechanical conveyor draws pulverulent material from a magazine and a mechanical transfer device applies the withdrawn material to selected portions of one side of a running web of cigarette paper, imitation cork or like wrapping material.

It is already known to apply bronze powder or like pulverulent coloring matter to running webs of wrapping material which is about to be draped around fillers of cigarettes, cigars, cigarillos or filter rods. For example, commonly owned U.S. Pat. No. 3,820,505 (granted June 28, 1974 to Goldbach et al.) discloses an apparatus wherein an endless conveyor with spherical material-entraining elements transfers pulverulent coloring matter from a main magazine to a smaller magazine which contains an intermediate supply of pulverulent coloring matter and from which the coloring matter is removed for transfer onto selected (adhesive-coated) portions of one side of the running web. The conveyor transports its spherical entraining elements along an endless path a portion of which extends through the main magazine and the entraining elements return the surplus from the intermediate supply into the main magazine. This results in continuous mechanical stressing of the coloring matter.

OBJECTS AND SUMMARY OF THE INVENTION

An object of the invention is to provide a relatively simple, compact and readily scalable apparatus which is constructed and assembled in such a way that pulverulent coloring matter which is to be applied to selected portions of one side of a travelling web of cigarette paper or the like is not subjected to repeated mechanical stresses.

Another object of the invention is to provide an apparatus which prevents agglomeration or caking of pulverulent coloring matter between the main magazine and the location where the coloring matter is applied to the web.

A further object of the invention is to provide the apparatus with novel and improved means for transporting pulverulent coloring matter from the magazine to the device which applies coloring matter to the running web.

An additional object of the invention is to provide the apparatus with novel and improved means for collecting the surplus of withdrawn coloring matter.

An ancillary object of the invention is to provide the apparatus with novel and improved means for drawing pulverulent coloring matter from the main magazine in such a way that the bulk of coloring matter in the magazine is held out of contact with moving parts.

Another object of the invention is to provide an apparatus which can be used as a superior substitute for presently known apparatus that apply bronze powder or the like to webs of cigarette paper or other suitable wrapping material in machines for the making of smoker's products.

A further object of the invention is to provide the apparatus with novel and improved means for maintaining the running web in an optimum position for the application of pulverulent coloring matter thereto.

The invention is embodied in an apparatus for applying pulverulent coloring matter to a travelling web one side of which is at least partly adhesive, particularly for applying particles of bronzing material to a web of cigarette paper or the like. The apparatus comprises a main magazine for a supply of pulverulent coloring matter, a transfer device (preferably a driven wheel) which is positioned to apply coloring matter to the one side of the travelling web, and means for transporting coloring matter from the magazine to the transfer device. In accordance with a feature of the invention, the transporting means comprises a helical conveyor (e.g., a screw or worm conveyor) having one or more helical threads defining one or more helical grooves for delivery of pulverulent material from the magazine into the range of the transfer device.

In accordance with another feature of the invention, the apparatus comprises a brush whose bristles extend into the helical groove or grooves of the conveyor to prevent agglomeration of pulverulent coloring matter in the grooves and to promote the transport of coloring matter toward the transfer device.

Still further, the apparatus preferably comprises means (e.g., a portion of the aforementioned magazine or a separate housing) which defines a chamber for reception of some coloring matter which is transported by the conveyor. The transfer device dips into the chamber and withdraws therefrom a film of coloring matter for application to the one side of the running web.

The conveyor is preferably formed with an inlet upstream of and with an outlet downstream of the chamber. The inlet receives surplus coloring matter which fails to adhere to the one side of the travelling web and admits such surplus into the groove or grooves of the conveyor. The outlet receives coloring matter which advances in the groove or grooves beyond the chamber, and the outlet returns such coloring matter into the magazine.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
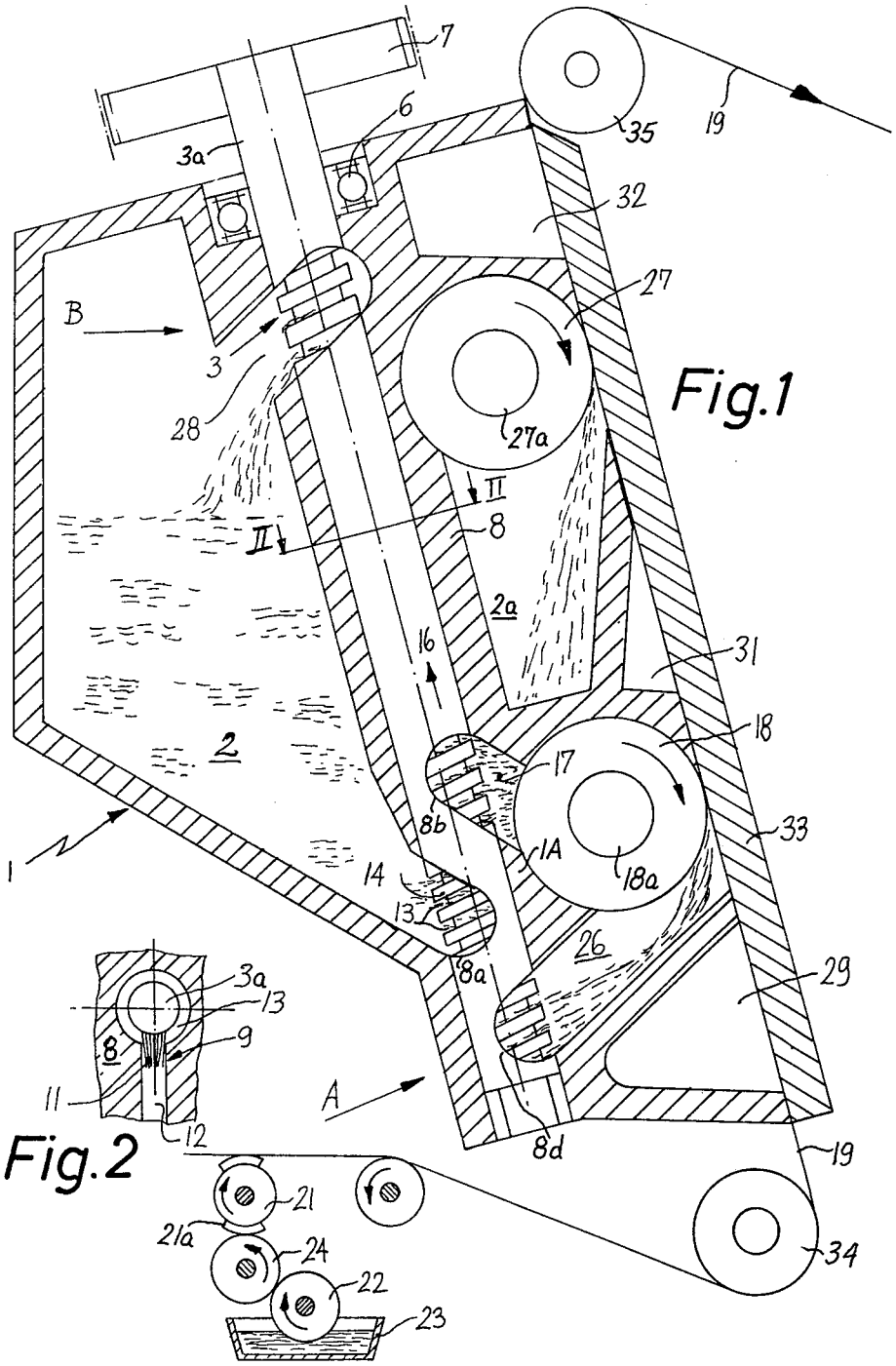
FIG. 1 is a sectional view of an apparatus which embodies the invention.
FIG. 2 is a fragmentary sectional view as seen in the direction of arrows from the line II—II of FIG. 1.

The apparatus which is shown in FIG. 1 comprises a main magazine 1 which contains a relatively large supply 2 of pulverulent coloring matter, e.g., bronze powder. A helical conveyor 3 includes a rotary feed screw 3*a* whose core is rotatably mounted in antifriction ball bearings 6 (one shown) which are installed in the housing of the magazine 1. The thread 14 of the feed screw 3*a* withdraws pulverulent material (hereinafter called powder for short) from the lower portion of the magazine 1. The feed screw 3*a* rotates in a cylindrical sleeve or jacket 8 which forms part of the conveyor 3 and has an opening 8*a* for admission of powder from the magazine 1 into the helical groove 13 of the rotating feed screw. The means for rotating the feed screw 3*a* comprises a gear 7 which is secured to its upper end portion, as viewed in FIG. 1, and receives torque from an endless toothed belt, not shown. The rotational speed of the feed screw 3*a* is relatively low, e.g., 30 revolutions per minute.

FIG. 2 shows that the sleeve 8 is formed with a longitudinally extending slot 9 for a brush 12 whose bristles 11 engage the rotating feed screw 3*a* in order to prevent agglomeration of powder in the helical groove 13. The slot 9 and the brush 12 can extend along the full length of the sleeve 8. The bristles 11 not only prevent caking of powder in the groove 13 but also promote the transport of powder in the direction indicated by the arrow 16. The illustrated conveyor 3 with a feed screw 3*a* having square threads 14 constitutes but one form of helical conveyors which can be utilized in the apparatus of the present invention. Thus, one can employ any other helical conveyor (e.g., a worm conveyor) which advances powder along a helical path in response to rotation of the rotary component about its own axis.

The thread 14 of the feed screw 3*a* delivers powder into a chamber 17 which is adjacent to a rotating transfer wheel 18. The chamber 17 is defined by a part 1A which may constitute an integral portion of the housing of the main magazine 1. The shaft 18*a* of the wheel 18 is driven to rotate in the direction which is indicated by the arrow whereby the peripheral surface of the wheel 18 transfers powder to selected longitudinally spaced portions of the left-hand side of a running web 19 consisting of cigarette paper or the like. The means for preparing selected portions of one side of the web 19 for retention of powder comprises a paster which is installed ahead of the transfer wheel 18 and includes a tank 23 for a supply of liquid adhesive, a withdrawing roller 22 which dips into the supply of adhesive in the tank 23, an intermediate roller 24 which removes a film of adhesive from the periphery of the withdrawing roller 22, and a rotary roller-shaped applicator 21 having one or more raised peripheral portions 21*a* which contact the selected portions of the running web 19 and apply spots of adhesive thereto. The configuration of such spots matches the trade name of the manufacturer, the brand name of the smokers' products and/or other indicia. The manner in which the web 19 is withdrawn from a roll and is transported into the machine wherein the web is draped around a filler of tobacco or filter material forms no part of the present invention. Reference may be had, for example, to commonly owned U.S. Pat. No. 4,037,608 granted July 26, 1977 to Wahle. The apparatus of the present invention can replace the apparatus 13 which is shown in FIG. 1 of the patent to Wahle.

The surplus of powder which does not adhere to the running web 19 during travel past the transfer wheel 18 is delivered by the wheel 18 into a connecting passage 26 for reintroduction into the helical groove 13 of the feed screw 3*a* at a location A which is disposed upstream of the removing station (opening 8*a* of the sleeve 8). Thus, the main magazine 1 supplies only a certain percentage of powder which is transported into the chamber 17; the remaining percentage of powder is furnished by the connecting passage 26. This means that the conveyor 3 need not agitate and mechanically stress the major part of the supply 2 in the main magazine. The sleeve 8 has a discharge opening 8*b* which admits powder into the chamber 17 and an inlet 8*d* which communicates with the passage 26 and admits powder into the groove 13.

A surplus removing roller 27 (whose shaft 27*a* is driven to rotate in the direction indicated by the arrow) is adjacent to the path of movement of the web 19 downstream of the transfer wheel 18. The periphery of the roller 27 may be provided with bristles and this roller serves to brush off the surplus of powder from the web 19 before the latter leaves the magazine 1. The removed surplus is returned into the main supply 2 of powder, as at 2*a*.

The sleeve 8 has an outlet 28 at a level above the chamber 17 (i.e., downstream of the chamber 17 as considered in the direction of movement of powder in the groove 13 of the feed screw 3*a*). The outlet 28 allows the surplus of powder which is carried by the threads 14 above and beyond the chamber 17 to reenter the main supply 2 in the magazine 1. The zone B where the outlet 28 is located is selected in such a way that the returned surplus descends on top of the supply 2 in the main magazine 1.

The reference characters 29, 31 and 32 denote suction chambers which insure that the left-hand side of the web 19, as viewed in FIG. 1, bears against the peripheries of the transfer wheel 18 and surplus removing roller 27 during travel from a guide roller 34 toward a guide roller 35. The chambers 29, 31, 32 further insure that the web 19 seals the interior of the magazine 1 and the passage 26 from the atmosphere, i.e., that the powder cannot leave the apparatus except by adhering to the adhesive-coated portions of one side of the web. The apparatus further comprises a pressure plate 33 which is sufficiently close to the transfer wheel 18 and to the roller 27 to assist suction in the chambers 29, 31 and 32, i.e., the pressure plate 33 also insures that the web 19 invariably contacts the peripheral surfaces of the transfer wheel and surplus removing roller.

An important advantage of the improved apparatus is that it occupies little room, that it can be readily sealed against escape of powder, and that the powder is subjected to negligible mechanical stresses. Moreover, the apparatus prevents agglomeration of powder in or on the feed screw 3*a;* this is especially important when the conveyed material is bronze powder because bronze powder belongs to the class of powders called "fatty" powders. Such powders exhibit a rather pronounced tendency to adhere to the surfaces which are in contact therewith.

A further advantage of the improved apparatus is that the quantity of powder which was once withdrawn from the main supply 2 and is thereupon returned to the magazine 1 is surprisingly low. This is due to the fact that the surplus which is withdrawn from the chamber 17 is returned into the groove 13 via connecting passage 26. Thus, the magazine 1 receives only that (relatively small) quantity of once-withdrawn powder which is removed by the roller 27 and leaves the groove 13 via outlet 28.

The manner in which the main magazine 1 receives pulverulent coloring matter, either continuously or at required intervals, forms no part of the invention. The supply of such material need not be replenished at frequent intervals because the operation is economical, primarily because the apparatus is adequately sealed to prevent uncontrolled escape of coloring matter. Gentle treatment of coloring matter is insured because the thread 14 removes from the magazine only such quantities of coloring matter which are needed to supplement the coloring matter that is returned into the groove 13 via connecting passage 26.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for applying pulverulent coloring matter to a running web one side of which is at least partly adhesive, particularly for applying particles of bronzing material to a web of cigarette paper or the like, comprising a magazine for a supply of coloring matter; a transfer device positioned to apply coloring matter to said one side of the running web; means for transporting coloring matter from said magazine to said transfer device, said transporting means comprising a helical conveyor and said conveyor comprising a rotary component having a helical groove and a sleeve surrounding said rotary component, said sleeve having an opening through which some of the transported coloring matter is discharged into the range of said transfer device, an inlet located upstream of said opening and arranged to deliver coloring matter to said groove and an outlet communicating with said magazine and located downstream of said opening to return into said magazine coloring matter which advances in said groove beyond said opening; means defining a chamber for coloring matter which is transported by said conveyor, said transfer device extending into and receiving coloring matter from said chamber and said chamber receiving a portion of the coloring matter which is transported by said conveyor, said outlet being located downstream of said chamber, as considered in the direction of transport of coloring matter from said magazine, to return the remaining portion of said transported coloring matter into said magazine, said inlet being located upstream of said chamber, as considered in the direction of transport of coloring matter from said magazine to said chamber, and said transfer device being arranged to draw from said chamber coloring matter in quantities exceeding the quantity which is retained by said one side of the web so that the non-retained matter forms a surplus; and means for conveying said surplus to said conveyor.

2. Apparatus as defined in claim 1, further comprising a brush having bristles extending into said groove.

3. Apparatus as defined in claim 1, wherein said transfer device comprises a rotary member whose peripheral surface contacts said one side of the running web.

4. Apparatus as defined in claim 1, wherein said conveyor is a screw conveyor.

5. Apparatus as defined in claim 1, further comprising means for removing eventual surplus of coloring matter from said one side of the web downstream of said transfer device.

6. Apparatus as defined in claim 1, wherein said transfer device comprises a rotary member and further comprising means for biasing said one side of the running web against said rotary member.

* * * * *